US007624524B2

(12) United States Patent
Mullins

(10) Patent No.: US 7,624,524 B2
(45) Date of Patent: Dec. 1, 2009

(54) SELF-ADHERING PERFORATED DISPLAY ASSEMBLY

(75) Inventor: Jeffrey M. Mullins, Statesville, NC (US)

(73) Assignee: East Coast Perforating, Inc., Statesville, NC (US)

( * ) Notice: Subject to any disclaimer, the term of this patent is extended or adjusted under 35 U.S.C. 154(b) by 33 days.

(21) Appl. No.: 11/832,787

(22) Filed: Aug. 2, 2007

(65) Prior Publication Data

US 2008/0052973 A1 Mar. 6, 2008

Related U.S. Application Data

(60) Provisional application No. 60/821,202, filed on Aug. 2, 2006.

(51) Int. Cl.
*G09F 21/04* (2006.01)

(52) U.S. Cl. ..... 40/593; 40/594; 40/649; 40/516; 296/97.3

(58) Field of Classification Search ..... 40/593; 428/913.3; 359/625, 626; 283/85, 87, 89, 283/91, 98, 61, 62; 296/97.3
See application file for complete search history.

(56) References Cited

U.S. PATENT DOCUMENTS 1,470,486 A * 10/1923 Russell ..... 40/591
3,868,293 A * 2/1975 Selph ..... 428/40.1
4,055,012 A * 10/1977 Cote ..... 40/611.06
4,194,305 A * 3/1980 Smith et al. ..... 434/150
4,521,492 A * 6/1985 Allen ..... 428/464
4,749,222 A * 6/1988 Idland ..... 296/152
4,862,944 A * 9/1989 Hendershot ..... 160/370.21
4,955,153 A * 9/1990 Albrecht et al. ..... 40/661
5,226,792 A * 7/1993 Darago ..... 40/591
5,609,938 A * 3/1997 Shields ..... 428/138
5,773,110 A * 6/1998 Shields ..... 428/40.1
5,925,437 A * 7/1999 Nelson ..... 428/137
6,004,649 A * 12/1999 Nagata ..... 428/107
6,176,958 B1 * 1/2001 Shea ..... 156/253
6,298,590 B1 * 10/2001 Levinson ..... 40/591
6,984,283 B1 * 1/2006 Noriega ..... 156/256
7,513,674 B1 * 4/2009 Donahue ..... 362/627
2005/0133153 A1 * 6/2005 Fiechter ..... 156/277
2006/0080875 A1 * 4/2006 Nelson et al. ..... 40/593

* cited by examiner

*Primary Examiner*—Lesley Morris
*Assistant Examiner*—Kristina Staley
(74) *Attorney, Agent, or Firm*—Adams Intellectual Property Law

(57) ABSTRACT

A one-way vision perforated display panel that includes a transparent protective envelope having at least one open side edge and an adhesive applied to at least a portion of an outwardly-facing side of the envelope defined by a front sheet for adhering the envelope to an inner surface of a transparent support panel, and a one-way vision, perforated sheet having a display image on one side for being inserted into the protective envelope through the at least one open side edge with the display image visible through the outwardly-facing side of the envelope and the transparent support panel.

12 Claims, 2 Drawing Sheets

SELF-ADHERING PERFORATED DISPLAY ASSEMBLY

This application claims priority to U.S. Provisional Patent No. 60/821,202 filed on Aug. 2, 2006.

TECHNICAL FIELD AND BACKGROUND OF THE INVENTION

This invention relates to a one-way vision perforated display panel and a method for producing such a display panel. Prior art one-way vision panels generally comprise a perforated clear sheet bearing a graphic design and supported until use by a backing sheet. The clear plastic sheet with the design is referred to as a decalcomania, or decal. After removal of the backing sheet, the clear sheet bearing the graphic design is placed on the inside surface of a transparent panel, such as a car window, in such manner as the graphic design is visible to observers viewing the decal from the outside. The perforations permit those inside the vehicle to see out of the window without seeing the graphic design. Of course, such decals can be applied to any transparent surface, and have been also been applied to a combination of transparent and non-transparent exterior structures, such as the side of a bus, whereby even the windows appear from the outside to have been painted over.

The perforations perform no function on the side of the panel from which the image is viewed. The eyes fill in the perforations, i.e., the missing parts of the image, when viewing from the image side, creating the illusion of a solid image. The real function of the perforations is from the opposite, black opaque side. The combination of the black opaque panel and the perforations allow the observer to see through the panel from the reverse side, observing and comprehending whatever can be seen on the other side of the panel. The eyes fill in the parts of what is being observed which are blocked by the black, opaque part of the panel, creating the illusion of a transparent panel.

Prior art one way decals are typically made by using a pressure-sensitive adhesive-coated vinyl film to carry the graphic designs. The vinyl film is first perforated, then an image is applied to the film using one of several different printing technologies. The adhesive-coated vinyl film is carried on a paper backing until use, when it is removed and placed on the window or other transparent surface.

The present invention includes a transparent protective pouch or envelope within which is inserted a perforated, printed sheet, such as a piece of plastic or paper. The image is therefore visible from the outside and can be seen through from the inside. The envelope is part of the assembly, and permits an advertiser to replace advertising more frequently with less expense.

SUMMARY OF THE INVENTION

Therefore, it is an object of the invention to provide a perforated, see-through sheet for carrying graphic or text material, or a combination of graphic and text material.

It is another object of the invention to provide a perforated, see-through sheet that is inexpensive and that can therefore be replaced more often.

It is another object of the invention to provide a perforated, see-through sheet that is used in combination with a protective covering, such as a pouch or envelope, that protects the sheet and holds in it place in a display position.

These and other objects of the invention are achieved by providing a one-way vision perforated display panel, comprising a transparent protective envelope having at least one open side edge and an adhesive applied to at least a portion of an outwardly-facing side of the envelope defined by a front sheet for adhering the envelope to an inner surface of a transparent support panel; and a one-way vision, perforated sheet having a display image on one side for being inserted into the protective envelope through the at least one open side edge with the display image visible through the outwardly-facing side of the envelope and the transparent support panel.

According to one embodiment of the invention, the envelope includes a inwardly-facing side of the envelope defined by a back sheet.

According to another embodiment of the invention, the envelope includes a inwardly-facing side of the envelope defined by a back sheet having a dark color dye applied thereto, and further wherein the perforated sheet is devoid of a dark color applied thereto.

A method of displaying a one-way vision display image comprises the steps of providing a transparent protective envelope, applying an adhesive to at least a portion of an outwardly-facing side of the envelope defined by a front sheet for adhering the envelope to an inner surface of a transparent support panel, providing a one-way vision, perforated sheet having a display image on one side, inserting the perforated sheet into the protective envelope with the display image visible through the outwardly-facing side of the envelope, adhering the envelope with the perforated sheet therein to the transparent support panel.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Referring now specifically to the drawings, a display sheet 10 is shown, and preferably comprises a paper sheet, such as a solid bleached sulfate paper with a clay coating on both sides. There are several manufacturers of this type of paper, including Mead WestVaCo. The sheet is perforated with a multitude of spaced-apart holes 15. A variety of perforation patterns can be used. In one typical embodiment, the sheet 10 may have 0.060" diameter holes 15 with a variable percentage of open area between the holes 15. Typical percentages of open area includes 50%, 30%, 25%, 15%, 12.5% and 7.5%. Other hole shapes, hole diameters, hole sizes and spacings are also possible.

Figure 1:
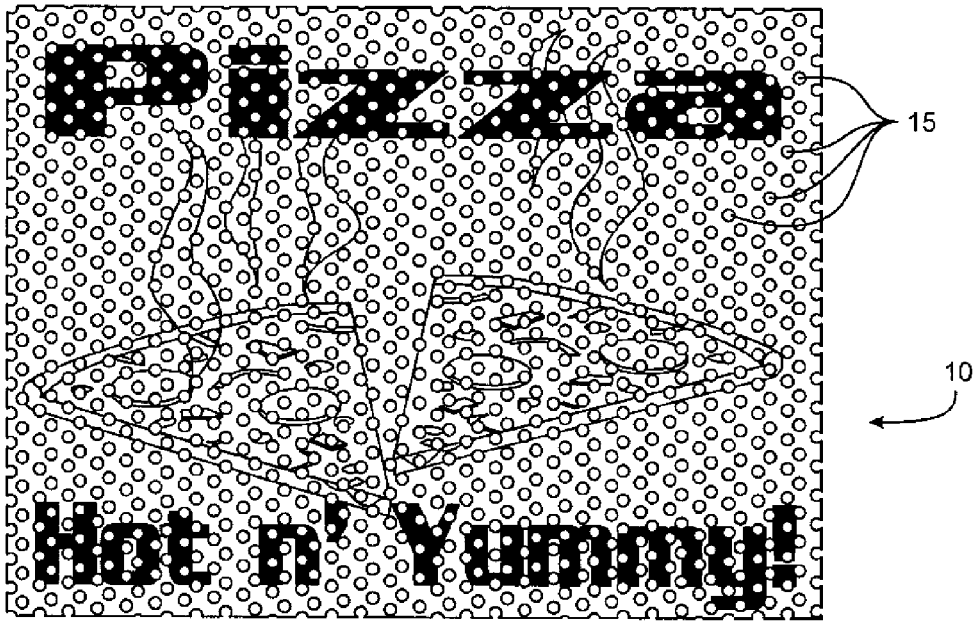
FIG. 1 is a illustration of the front, printed side of a display sheet according to an embodiment of the invention.
Figure 2:
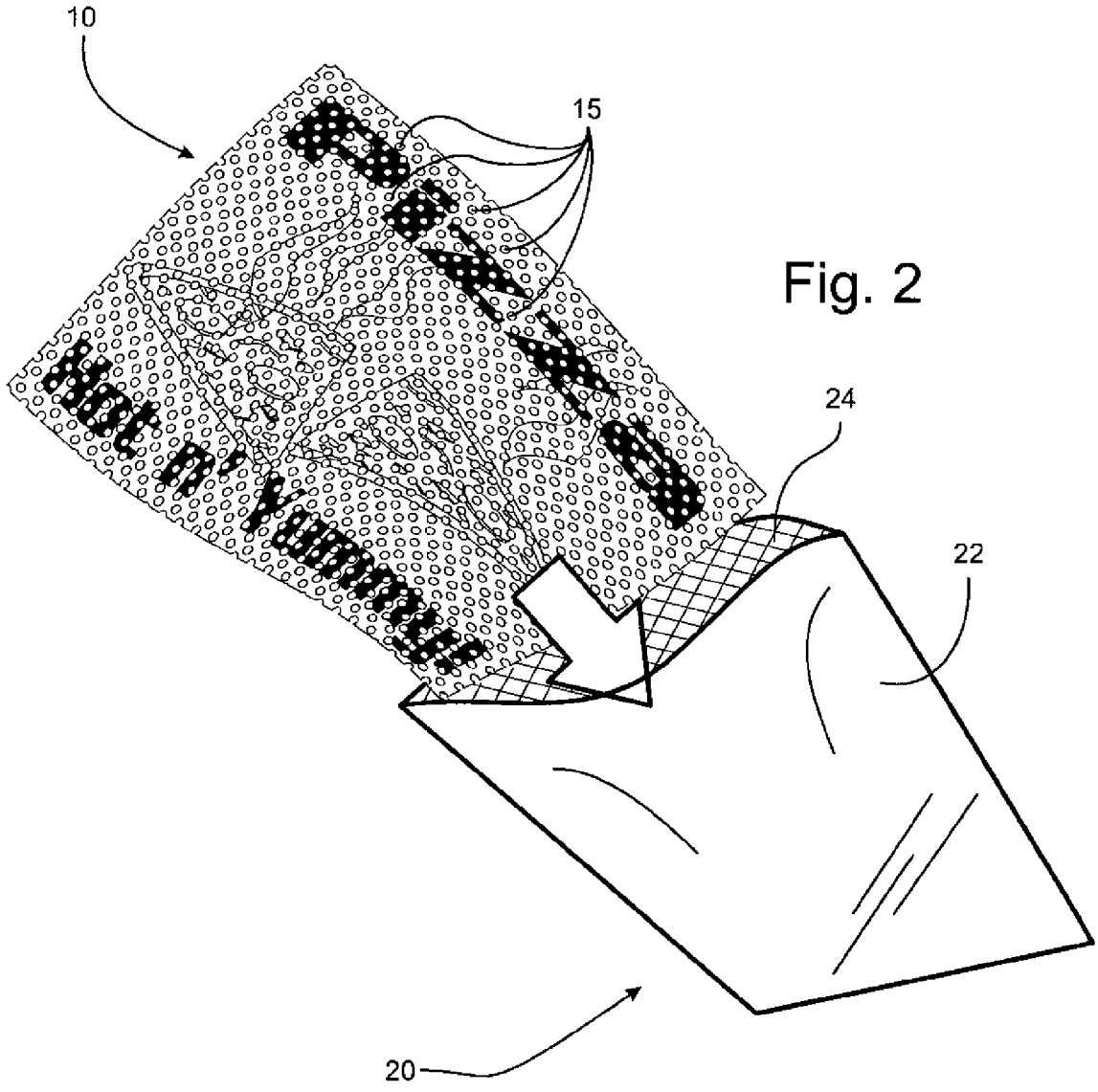
FIG. 2 is an illustration of the display sheet being placed into a protective envelope.

Preferably, the sheet 10 should be thick enough to be easily inserted into an envelope 20, as shown in FIG. 2. The sheet 10 is printed with any desired printed matter on a front side, shown in FIGS. 1 and 2. In contrast to prior art perforated display sheets, it is not necessary to apply a black back coating onto the reverse side of the sheet 10. Ordinarily, the reverse side will simply be the native color, usually white, of the sheet 10.

The envelope 20 is preferably fabricated of a 2 mil clear, adhesive-coated polyester front sheet 22, and a 4 mil dyed polyester back sheet 24. The sheets 22 and 24 are edge-joined together on at least two and preferably three sides by a suitable joining means, such as ultrasonic welding, heat welding, gluing, taping, and the like. The printed sheet 10 is inserted into the envelope 20 such that the printed matter shows through the front sheet 22. The dyed back sheet 24 performs the same function as dark-printed back side of prior art perforated sheets without the need to print the reverse side. The sheets 22 and 24 are available through numerous suppliers, such as CP Films, of Martinsville, Va.

Figure 3:
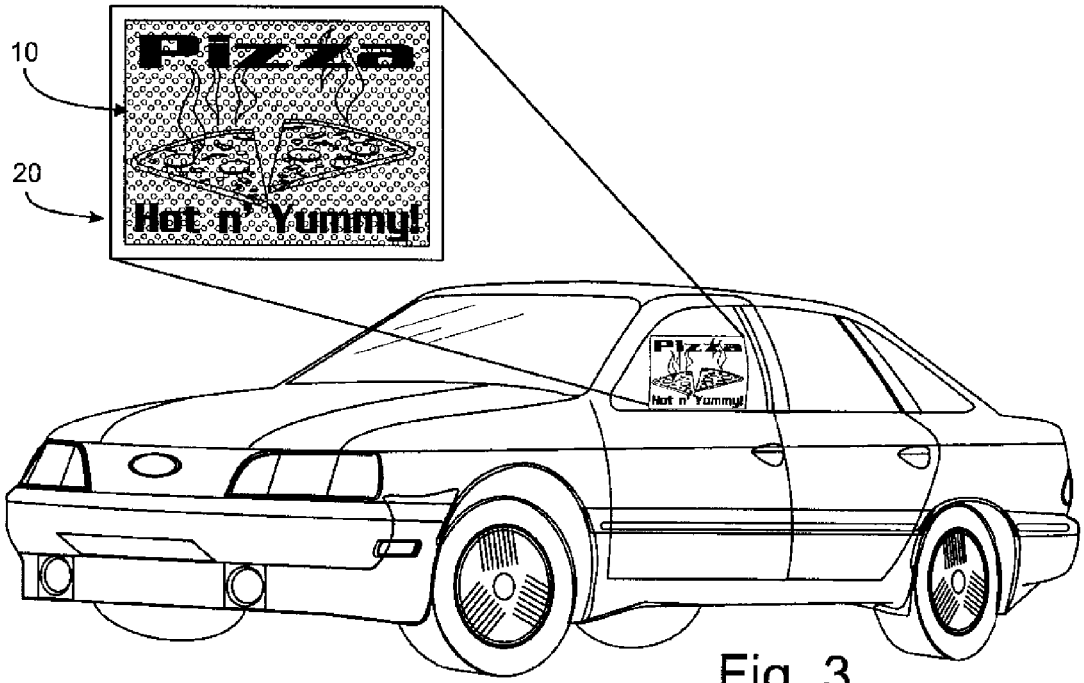
FIG. 3 is a view of the display sheet and envelope assembly in a typical use location.

As shown in FIG. 3, the envelope 20 with the inserted sheet 10 is mounted on the inside of a transparent support, such as a vehicle window, store window or the like by means of the adhesive coating on the front sheet 22. The printed material is easily visible, securely supported on the support surface, condensation on the sheet 10 is prevented, and the sheet 10 is isolated from dust, fingerprints and other contaminants.

In an alternative embodiment, not shown, an envelope may be formed by positioning a dyed sheet on the inside of a window or other transparent object. The dyed sheet is positioned and adhered only along edge portions, leaving a sufficient space unadhered, for example, one side, so that a perforated sheet, such as the sheet 10 described above containing graphical material can be inserted between the dyed sheet and the window or other transparent object. The sheet containing the graphical material is positioned between the dyed sheet and the transparent window with the graphical material visible outwardly through the window.

The dyed sheet may be positioned on the window by adhering it with an adhesive such as an optically clear removable adhesive applied to the desired edges of the dyed sheet, or with double-sided tape. A combination of the adhesive or tape can be used with, for example, a hook, fold in the top of the dyed sheet or other suitable means to mount the dyed sheet over the top of an vehicle window, and then trapping the top of the dyed sheet between the window and window frame.

Substantial savings result from the ability to use paper for the sheet 10, rather than much more expensive vinyl, and the ability to avoid having to apply a dark back liner to the sheet 10. The prior art process includes the steps of perforating, applying a solid backliner, printing and cutting sheet to size. The present invention allows a product of equal quality and durability to be produced less expensively.

Fast food restaurant vehicle window, point-of-purchase advertising and free standing displays are now able to be more frequently replaced. By way of example, one use of this product would be to sell a fast-food restaurant 6 months of advertising. It would be furnished with envelopes 20 and every month or at some other interval it would be furnished with a new sheet 10 with desired printing. The new sheet 10 would be substituted for the old sheet.

A one-way vision perforated display panel and a method for producing such a display panel is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A one-way vision perforated display assembly, comprising:

(a) a transparent protective envelope having at least one edge opening, an inwardly-facing side of the envelope defined by a back sheet having a light-transmissive dark color applied thereto, and an adhesive applied to at least a portion of an outwardly-facing side of the envelope defined by a front sheet for adhering the envelope to an inner surface of a transparent support panel; and (b) a one-way vision, perforated non-adhesive single layer display sheet having a display image on one side for being loosely and removably inserted into the protective envelope through the at least one edge opening with the display image visible through the outwardly-facing side of the envelope and the transparent support panel;

(c) the combination of the envelope and the display sheet therein being light-transmissive for allowing viewing through the entire assembly from a position rearward of the outwardly facing side of the envelope, whereby the perforated non-adhesive single layer display sheet is selectively replaceable when desired by another perforated non-adhesive single layer display sheet in the transparent protective envelope.

2. A one-way vision perforated display assembly according to claim 1, wherein the perforated sheet is devoid of a dark color applied thereto.

3. A one-way vision perforated display assembly according to claim 1, wherein the perforated sheet comprises a paper sheet.

4. A one-way vision perforated display assembly according to claim 1, wherein the perforated sheet comprises a solid bleached sulfate paper with a clay coating on both sides.

5. A one-way vision perforated display assembly according to claim 1, wherein the perforated sheet has perforations therein with a percentage of open area between the holes selected from the group of percentages consisting of 50%, 30%, 25%, 15%, 12.5% and 7.5%.

6. A one-way vision perforated display assembly according to claim 1, wherein the perforated sheet has perforations having a diameter of about 0.060".

7. A one-way vision perforated display assembly according to claim 1, wherein the perforated sheet is devoid of a black back coating on a reverse side of the sheet opposite the one side.

8. A one-way vision perforated display assembly according to claim 7, wherein the front sheet is about 2 mils thick.

9. A one-way vision perforated display assembly according to claim 7, wherein the back sheet is about 4 mils thick.

10. A one-way vision perforated display assembly according to claim 7, wherein the front and back sheets are joined by a joinder selected from the group consisting of ultrasonic welding, heat welding, gluing and taping.

11. A one-way vision perforated display assembly, comprising:

(a) a transparent protective envelope having at least one edge opening, an inwardly-facing side of the enveloped defined by a back sheet having a light-transmissive dark color applied thereto, and an adhesive applied to at least a portion of an outwardly-facing side of the envelope defined by a front sheet for adhering the envelope to an inner surface of a transparent support panel; and (b) a one-way vision, perforated non-adhesive single layer display sheet having a display image on one side for being loosely and removably inserted into the protective envelope through the at least one edge opening with the display image visible through the outwardly-facing side of the envelope and the transparent support panel and the combination of the envelope and the display sheet therein being light-transmissive for allowing viewing through the entire assembly from a position rearwardly of the outwardly-facing side of the envelope, wherein the envelope is fabricated of a clear, adhesive-coated polyester front sheet and a dyed polyester back sheet edge-joined together on at least two sides.

12. A method of displaying a one-way vision display image, comprising the steps of:

(a) providing a transparent protective envelope having at least one edge opening and an inwardly-facing side of the envelope defined by a back sheet having a light-transmissive dark color applied thereto;

(b) applying an adhesive to at least a portion of an outwardly-facing side of the envelope defined by a front sheet for adhering the envelope to an inner surface of a transparent support panel;

(c) providing a one-way vision, perforated non-adhesive single layer display sheet having a display image on one side;

(d) loosely and removably inserting the perforated sheet into the protective envelope with the display image visible through the outwardly-facing side of the envelope; and (e) adhering the envelope with the perforated sheet therein to the transparent support panel, wherein the combination of the envelope and the display sheet therein is light-transmissive for allowing viewing through the envelope and display sheet from a position rearward of the outwardly-facing side of the envelope and for allowing removal and replacement of the perforated non-adhesive single layer display sheet when desired.

* * * * *